US008132283B1

(12) United States Patent
Downes

(10) Patent No.: US 8,132,283 B1
(45) Date of Patent: Mar. 13, 2012

(54) CLEANING APPARATUS

(76) Inventor: Timothy P. Downes, Newport, RI (US)

( * ) Notice: Subject to any disclaimer, the term of this patent is extended or adjusted under 35 U.S.C. 154(b) by 706 days.

(21) Appl. No.: 12/250,617

(22) Filed: Oct. 14, 2008

(51) Int. Cl.
*A46B 7/02* (2006.01)
*B25G 3/38* (2006.01)

(52) U.S. Cl. ..... 15/144.1; 15/172; 15/244.2; 16/900; 403/87; 403/91; 403/113; 403/116

(58) Field of Classification Search ..... 15/144.1, 15/144.2, 244.2, 172; 16/438, 900; 403/87, 403/91, 112, 113, 116
See application file for complete search history.

(56) References Cited

U.S. PATENT DOCUMENTS 1,151,139 A * 8/1915 Vosbrink ..... 15/229.7
1,735,644 A 11/1929 Hill
2,689,967 A 9/1954 Mackey
2,799,037 A 7/1957 Grogan
4,392,269 A 7/1983 Nishiyama et al.
4,882,802 A 11/1989 LeVere, Jr.
4,893,370 A * 1/1990 Klotz ..... 15/121
5,123,138 A 6/1992 Flamm
6,073,298 A * 6/2000 O'Brien ..... 15/160
6,128,800 A * 10/2000 Vosbikian ..... 15/172
6,523,212 B2 2/2003 Cesak et al.
6,571,419 B1 * 6/2003 Lee ..... 15/244.2
6,877,301 B2 * 4/2005 Nwosu et al. ..... 56/16.4 D
7,464,440 B2 * 12/2008 Decker ..... 16/422
7,721,377 B2 * 5/2010 Jungklaus et al. ..... 15/144.4
7,735,182 B2 * 6/2010 Morris et al. ..... 15/228
7,827,649 B2 * 11/2010 Horian ..... 15/144.2

* cited by examiner

*Primary Examiner* — Mark Spisich
*Assistant Examiner* — Michael Jennings
(74) *Attorney, Agent, or Firm* — Salter & Michaelson

(57) ABSTRACT

A push broom that is constructed of a broom head that includes a broom plate for supporting bristles or the like and having a rest surface and a bristle support surface; an elongated handle attached to the broom plate of the broom head and for controlling a sweeping action of the broom head and a pivotal coupling member for mounting the elongated handle with the broom head. The pivotal coupling member has separate positions including a rest position in which the broom head rests on the rest surface of the broom plate so that the handle is substantially upright to maintain the broom free-standing and an action position in which the handle is pivoted relative to the broom head so as to enable the sweeping action of the broom head by a user.

25 Claims, 14 Drawing Sheets

CLEANING APPARATUS

TECHNICAL FIELD

The present invention relates in general to a cleaning apparatus and pertains more particularly to an improved apparatus, the principles of which can be applied to a number of different types of cleaning apparatus such as a broom or mop. More particularly, the present invention relates to an improved push broom having separate useful positions including a rest position in which the broom is free standing and an action position in which the broom is ready for use by a user.

BACKGROUND OF THE INVENTION

A number of different types of broom, brush and mop constructions exist in the prior art. The following are some examples with brief associated descriptions.

U.S. Pat. No. 1,735,644 to Hill describes a combination scrubbing brush and mop holder.

U.S. Pat. No. 2,689,967 to Mackey describes an industrial broom with a swivel joint.

U.S. Pat. No. 2,799,037 to Grogan describes a broom and handle construction with an adjustable positioning of the handle.

U.S. Pat. No. 4,882,802 to LeVere, Jr. describes a broom holder for accepting a number of different commercially available broom handle adaptor attachments.

U.S. Pat. No. 5,123,138 to Flamm describes a combination sweeping tool and scraping tool.

U.S. Pat. No. 6,128,800 to Vosbikian describes a broom provided with a rotatable brush head connected to a handle.

U.S. Pat. No. 6,523,212 to Cesak et al. describes a push broom bracket device for connecting a rectangular-shaped broom brush head to a rod-shaped handle.

None of the foregoing prior art patents describe any broom and handle arrangement in which the handle is readily movable relative to the broom head to assume either an upright free-standing position or a use or action position.

Accordingly, it is an object of the present invention to provide an improved cleaning apparatus, particularly an improved push broom structure and in which the coupling between the handle and the broom head incorporates a pivot mechanism that enables the broom to be either in a rest position or an action position.

Another object of the present invention is to provide an improved cleaning apparatus, particularly in the form of a push broom or mop construction and in which the aforementioned rest and action positions can be switched therebetween in a readily effective manner.

SUMMARY OF THE INVENTION

To accomplish the foregoing and other objects, features and advantages of the present invention there is provided a cleaning apparatus that comprises a support head that includes a support plate and a cleaning member for support by the support plate with the support plate having a rest surface and a support surface; an elongated handle attached to the support plate of the support head and for controlling a sweeping action of the support head; and a coupling member for inter-connecting the elongated handle with the support head. The coupling member comprises a pivot mechanism having alternate rest and action positions. In the rest position the support head rests on the rest surface of the support plate so that the handle is substantially upright to maintain the cleaning apparatus substantially free-standing. In the action position the handle is pivoted relative to the support head so as to enable the sweeping action of the support head by a user of the apparatus.

In accordance with other aspects of the present invention the support head may be either a broom head with the cleaning member including bristles, or may be a mop head; the rest surface is preferably substantially orthogonal to the support surface; the pivot mechanism comprises a holding body that is attached to the support plate and a pivot sleeve received in the holding body and for accepting an end of the elongated handle; the pivot mechanism further includes a pivot pin supported by the holding body, and the pivot sleeve includes at least one slot in which the pivot pin moves in transitioning between the rest and action positions; or alternatively the pivot mechanism further includes a pivot pin supported by the pivot sleeve, and the holding body includes at least one slot in which the pivot pin moves in transitioning between the rest and action positions; the pivot mechanism further includes a pivot pin and a spring held by the pivot pin and disposed in the pivot sleeve; the pivot sleeve has an end engagement piece that selectively engages separately disposed receiving elements of the holding body that define the separate rest and action positions of the pivot mechanism; the end engagement piece is a post and the receiving element is a recess into which the post is engaged; and the holding body has adjacent recesses for receiving the end of the pivot sleeve that are separated by an acute angle.

Also, in accordance with the present invention there is provided a push broom that comprises a broom head that includes a broom plate for supporting bristles or the like and having a rest surface and a bristle support surface; an elongated handle attached to the broom plate of the broom head and for controlling a sweeping action of the broom head; and a pivotal coupling means for mounting the elongated handle with the broom head. The pivotal coupling means has separate positions including a rest position in which the broom head rests on the rest surface of the broom plate so that the handle is substantially upright to maintain the broom free-standing and an action position in which the handle is pivoted relative to the broom head so as to enable the sweeping action of the broom head by a user.

In accordance with still other aspects of the present invention the rest surface is preferably substantially orthogonal to the support surface; the pivotal coupling means comprises a holding body that is attached to the support plate and a pivot sleeve received in the holding body and for accepting an end of the elongated handle; the pivotal coupling means further includes a pivot pin supported by the holding body, and the pivot sleeve includes at least one slot in which the pivot pin moves in transitioning between the rest and action positions, the pivot sleeve rotating about its longitudinal axis in transitioning between the rest and action positions; the pivotal coupling means further includes a pivot pin supported by the pivot sleeve, and the holding body includes at least one slot in which the pivot pin moves in transitioning between the rest and action positions; the pivotal coupling means further includes a spring held by the pivot pin and disposed in the pivot sleeve; the pivot sleeve has an end engagement piece that selectively engages separately disposed receiving elements of the holding body that define the separate rest and action positions; the end engagement piece is a post and the receiving element is a recess into which the post is engaged; and the holding body has adjacent recesses for receiving the end of the pivot sleeve that are separated by an acute angle.

DESCRIPTION OF THE DRAWINGS

It should be understood that the drawings are provided for the purpose of illustration only and are not intended to define the limits of the disclosure. The foregoing and other objects and advantages of the embodiments described herein will become apparent with reference to the following detailed description when taken in conjunction with the accompanying drawings in which.

DETAILED DESCRIPTION

The principles of the present invention can apply to a variety of different types of cleaning devices. However, the principles of the present invention are particularly adapted for use with a push broom and also can apply to a mop structure. The present invention incorporates a spring-loaded handle that connects to the broom head by means of a pivot or cam arrangement that allows the handle to lock in different alternate positions. These positions include a rest position in which the broom is free standing as well as an action or sweeping position where the push broom can be used in its normal manner. The rest or storing position allows the head of the broom or the mop to rest at substantially 90 degrees to the handle. This allows the bristles to lay parallel to the floor surface so as to not damage the bristles. At the same time the handle, when in this position is maintained in a substantially upright and free standing position. With a twist of the handle either clockwise or counterclockwise, depending upon the particular structure, the broom head is disengaged and then re-engaged from the rest position to the action position.

Figure 10:
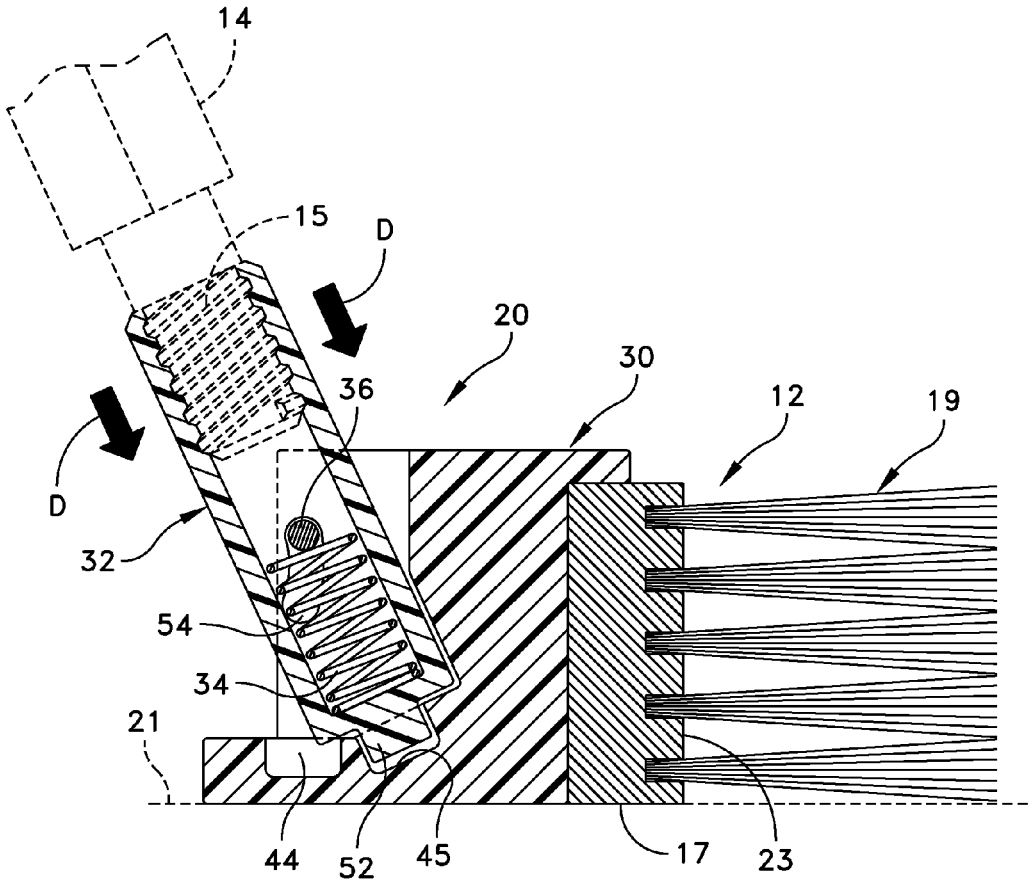
FIG. 10 is a cross-sectional view similar to that shown in FIG. 7 and illustrating the handle fully moved into the action position.
Figure 11:
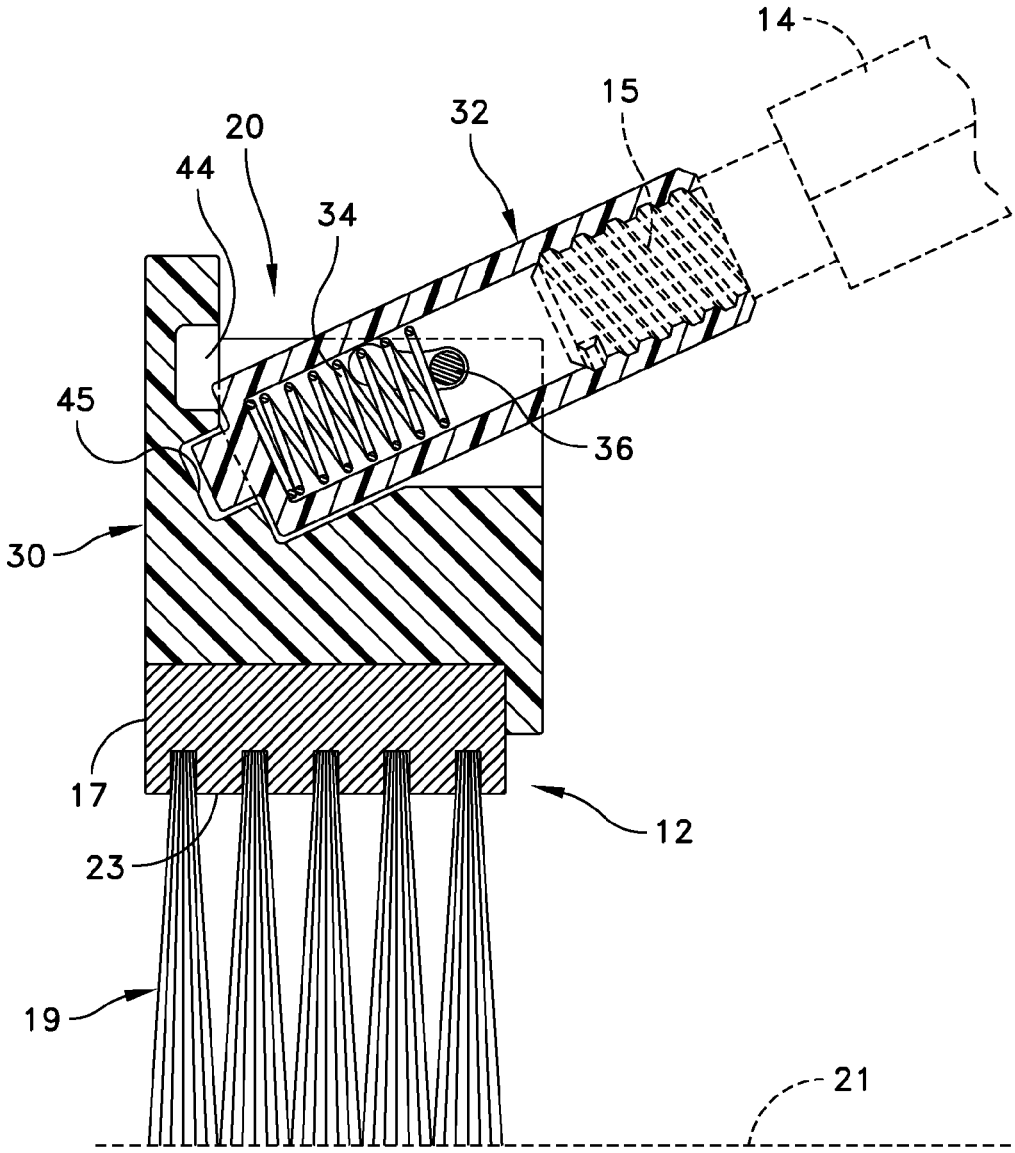
FIG. 11 is a cross-sectional view like that shown in FIG. 10 but with the apparatus rotated 90 degrees, illustrating the normal position of the push broom in use.
Figure 12:
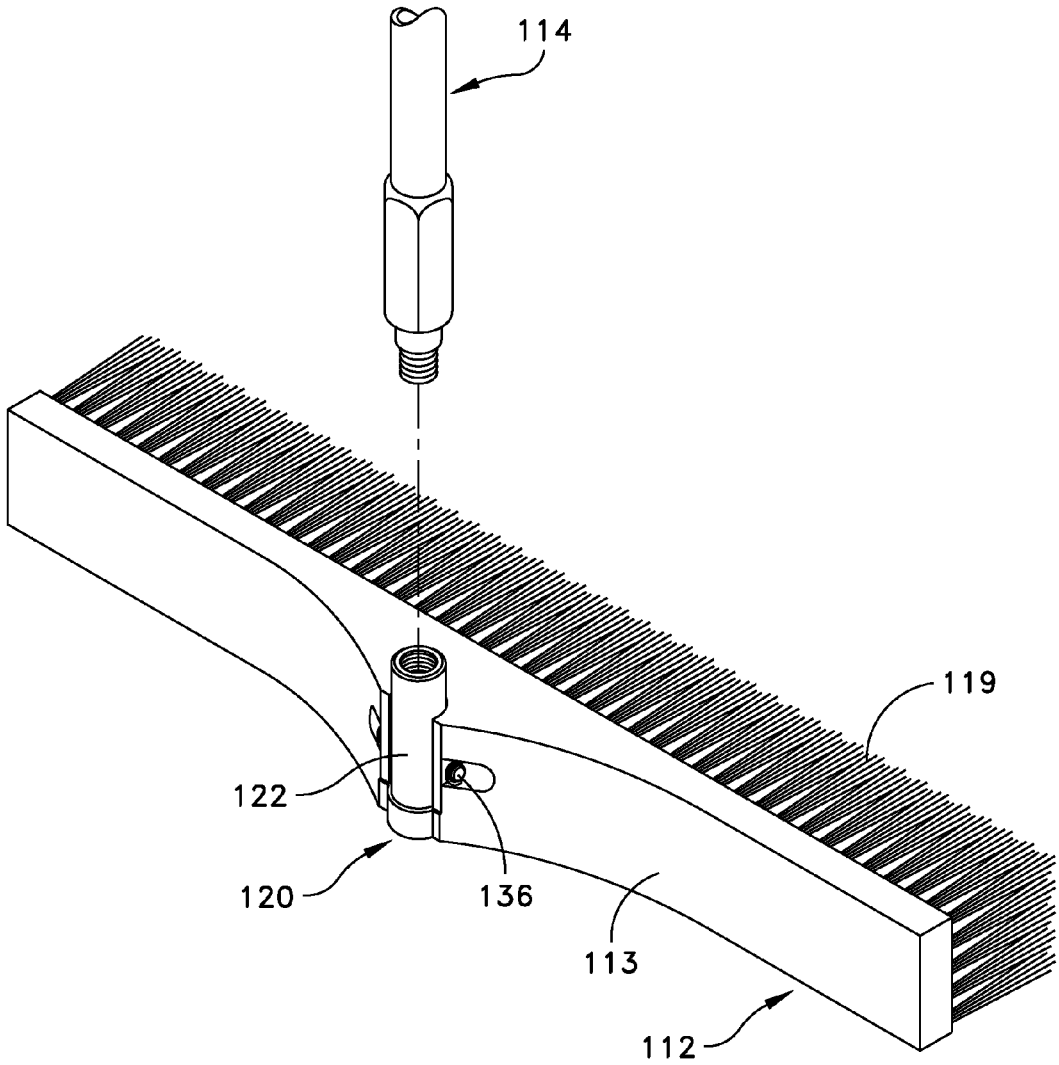
FIG. 12 is a perspective view of an alternate embodiment of the present invention but using a pivotal coupling mechanism similar to that previously described.
Figure 13:
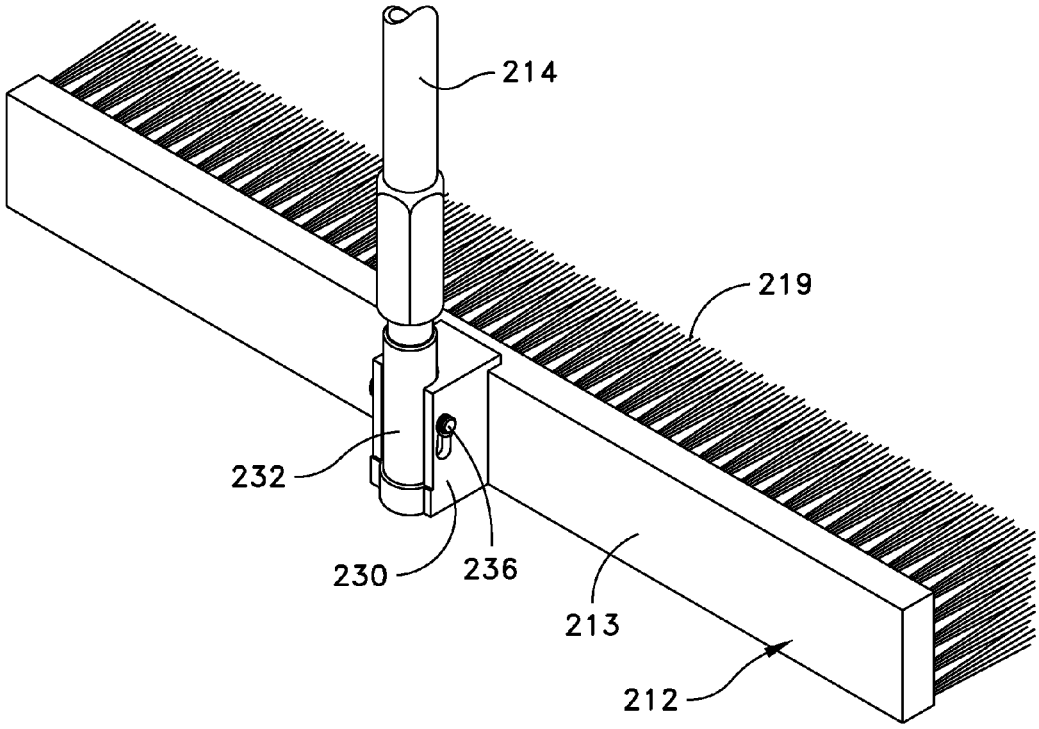
FIG. 13 is a fragmentary perspective view of a further embodiment of the present invention in which transition slots are provided in the body rather than in the sleeve.
Figure 14:
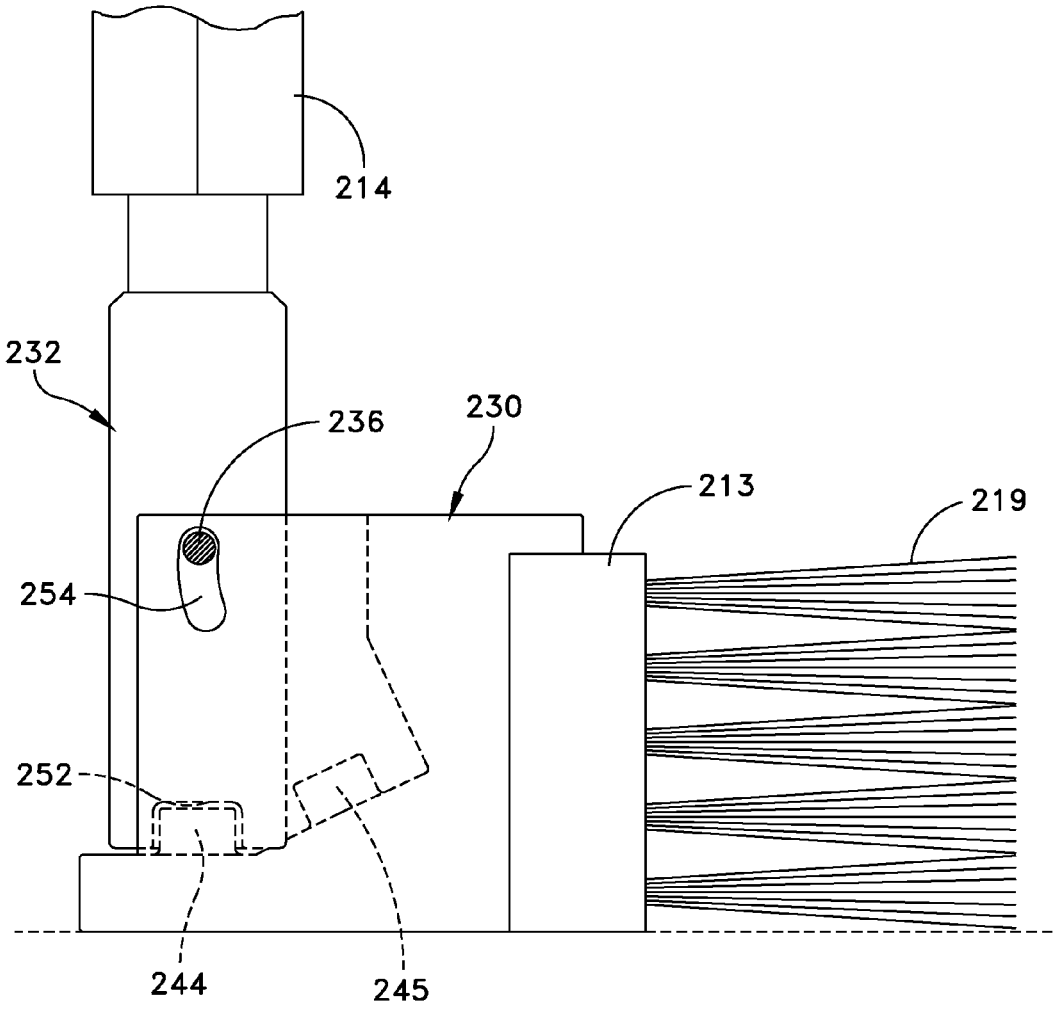
FIGS. 14 and 15 schematically illustrate the embodiment of FIG. 13 with the handle in respective rest and action positions.
Figure 15:
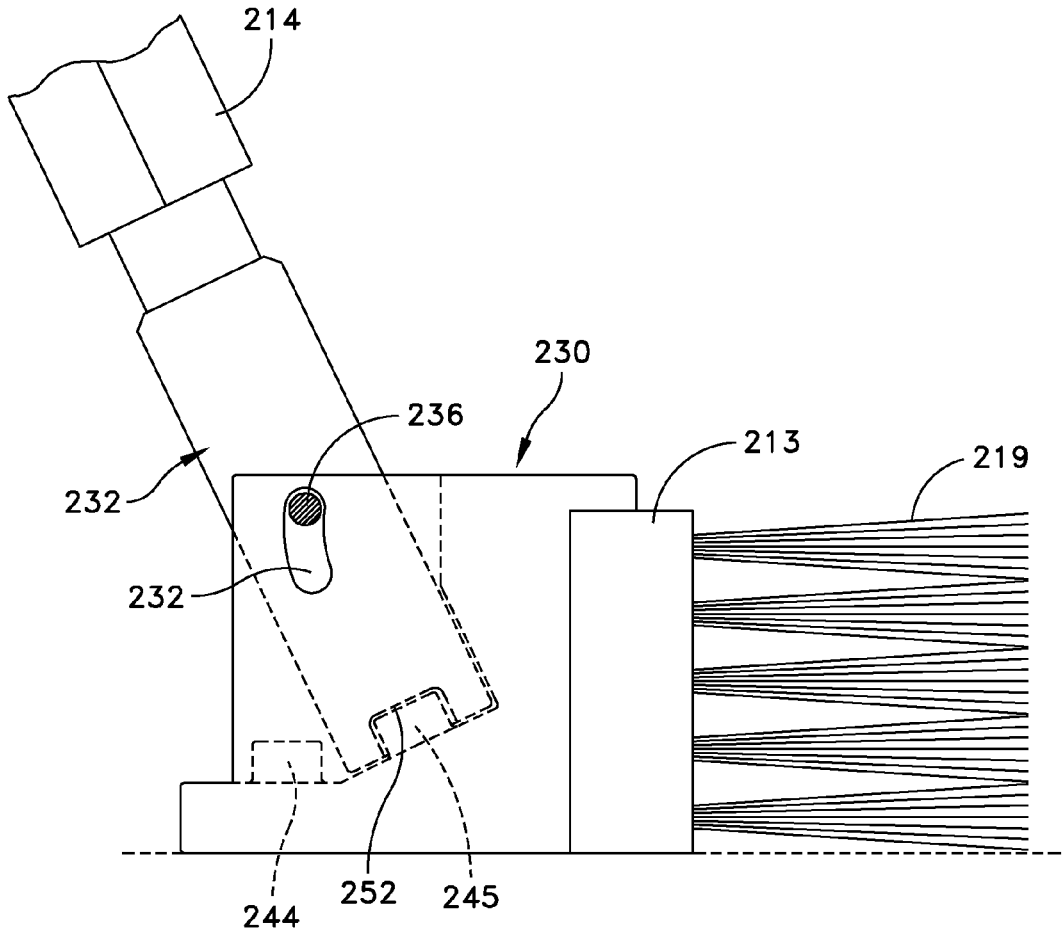

A preferred first embodiment of the present invention is illustrated in FIGS. 1-11. FIG. 12 is a perspective view illustrating a second embodiment of the present invention. However, the second embodiment of the present invention employs substantially the same coupling mechanism. The primary difference between this second embodiment in FIG. 12 and the first embodiment shown in FIGS. 1-11 is that the previous holding body is now integral with the broom head. FIGS. 13-15 illustrate an alternate embodiment of the present invention wherein the transition slot for movement of the handle is in the holding body rather than supported by the pivot sleeve. Also, in the embodiment of FIGS. 13-15 the inter-engagement in the separate positions between the handle and the broom is different employing instead a recess at the end of the pivot sleeve.

Figure 1:
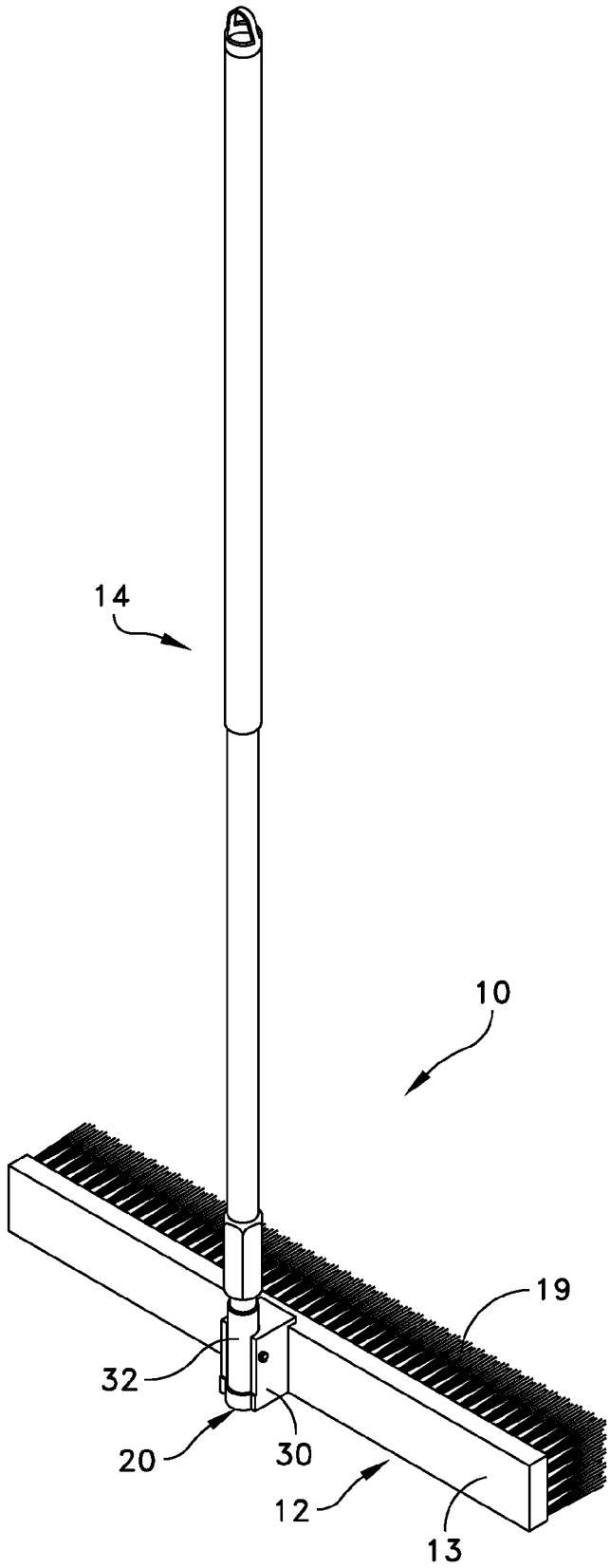
FIG. 1 is a perspective view of a push broom constructed in accordance with the principles of the present invention and illustrated in its rest position.
Figure 2:
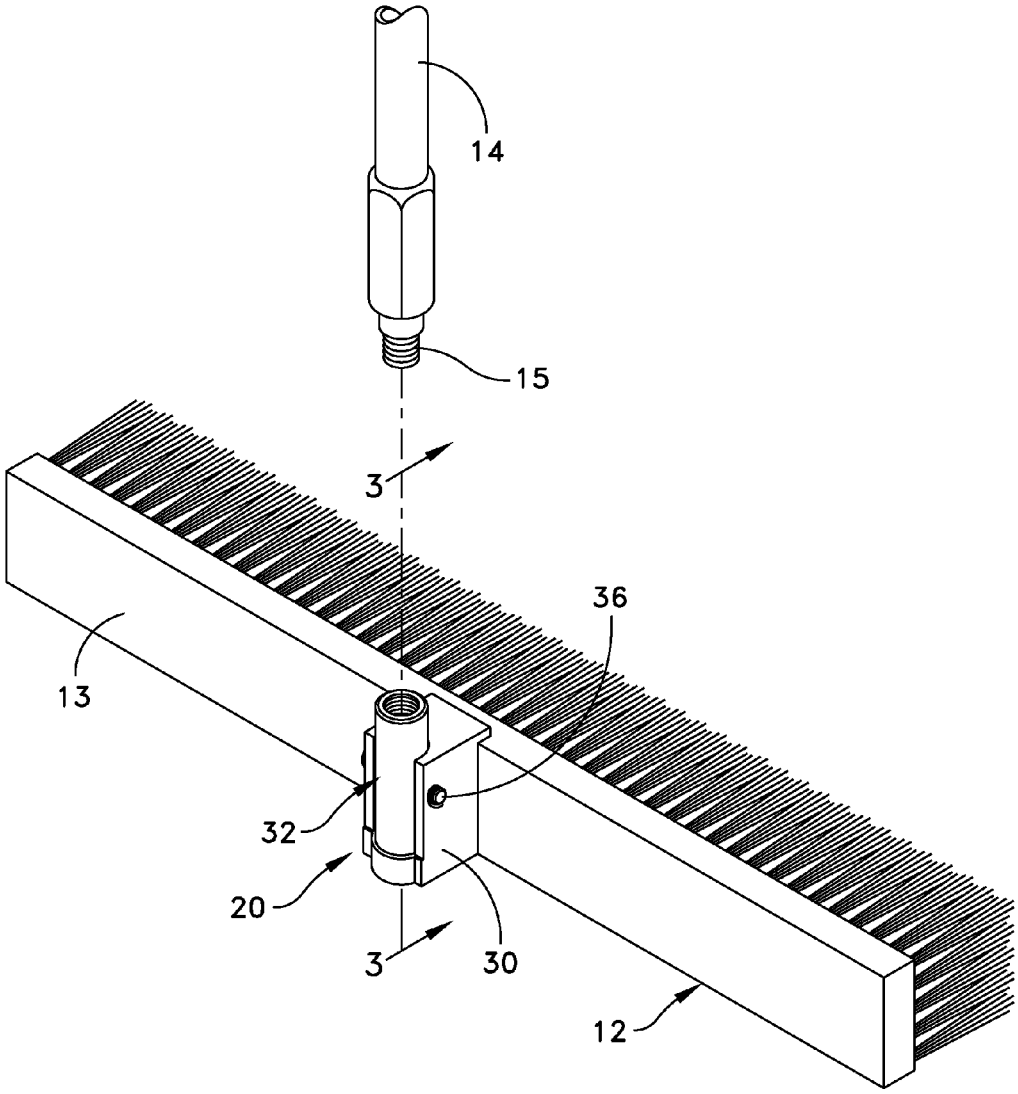
FIG. 2 is a fragmentary perspective view of the push broom of FIG. 1 illustrating the handle exploded away from the broom head.

Referring now to FIGS. 1-11, there is shown a push broom 10 that is comprised of a broom head 12 and an elongated handle or stick 14. The handle 14 may be considered as of conventional construction and may be provided in one or two inter-engaging pieces. As illustrated in FIG. 2, the lower end of the handle 14 is provided with a threaded connection illustrated at 15. A pivot mechanism 20 that functions as a two-position cam arrangement interconnects the broom head and handle.

Figure 4:
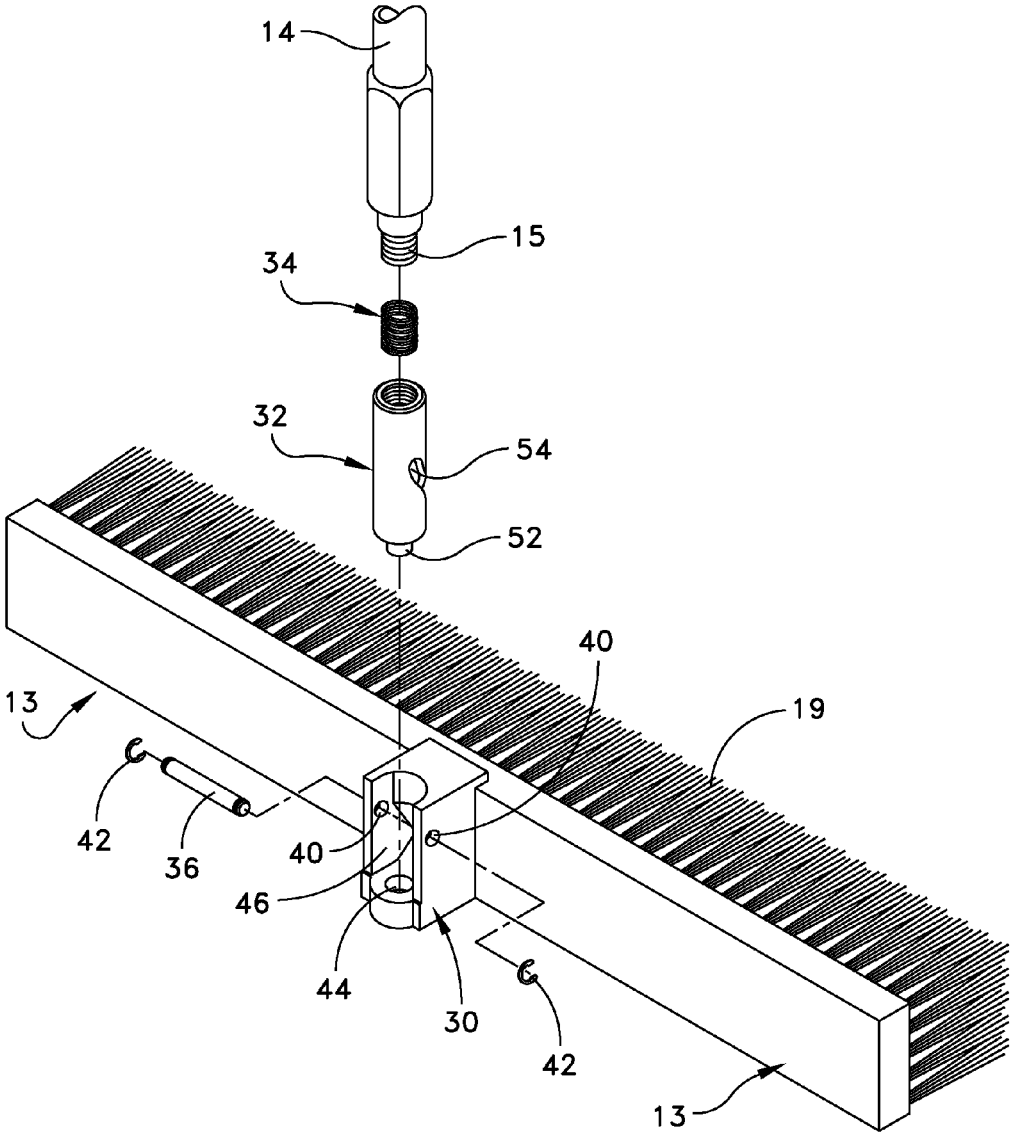
FIG. 4 is an exploded perspective view of the push broom construction shown in FIGS. 1-3.
Figure 7:
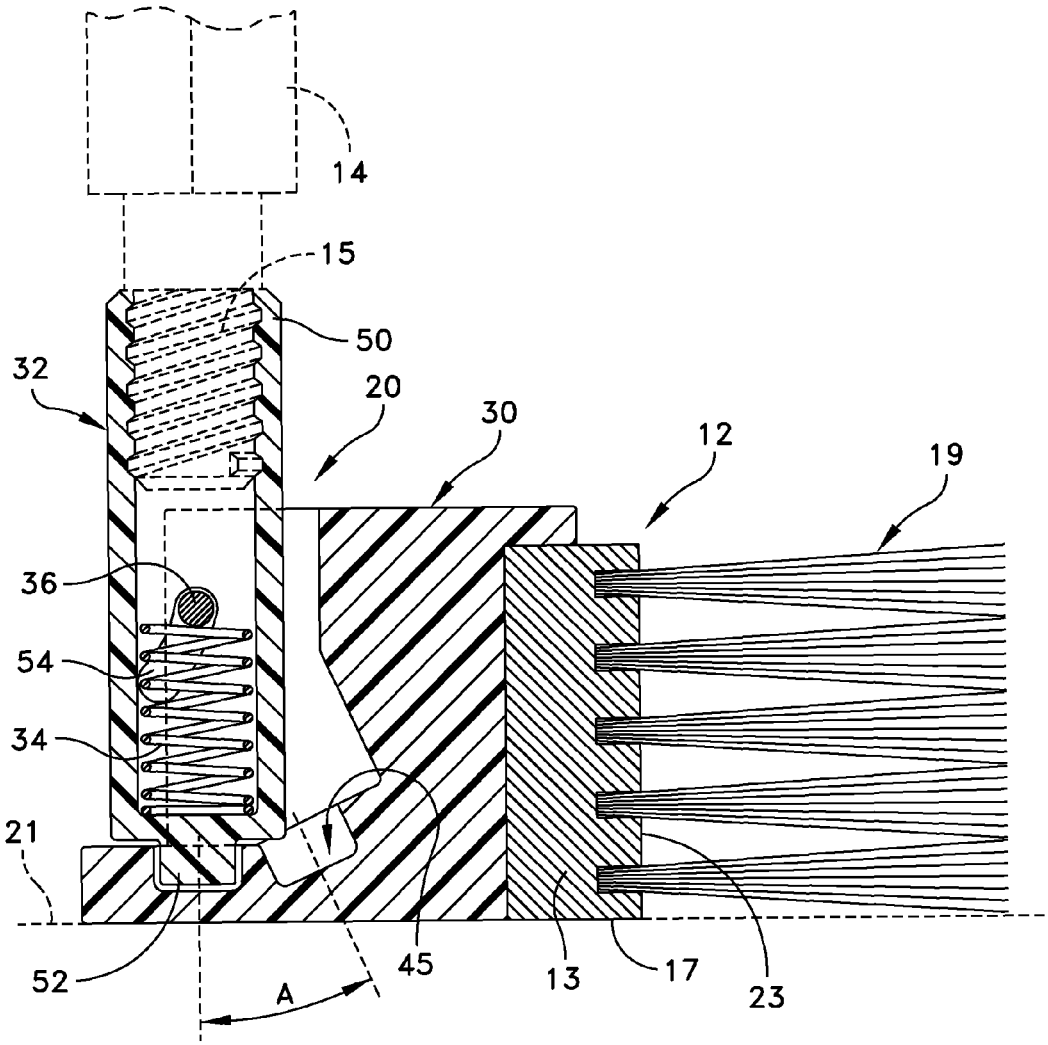
FIG. 7 is a cross-sectional view taken along line 7-7 of FIG. 3 and illustrating the handle in the rest position of the push broom.

FIG. 4 illustrates the pivot mechanism in an exploded view. This pivot mechanism may be considered as having separate positions including a first position corresponding to a rest position in which the broom head rests on a rest surface of the broom plate 13. This rest surface is shown in, for example, FIG. 7 at the rest surface 17. In this position, as noted in FIG. 7, the broom is free standing with the handle in a substantially upright position substantially perpendicular to the surface 17. It is noted that in the position of FIG. 7 the bristles 19 extend parallel to the floor surface 21 so that there is no damage to the bristles or defamation of the bristles when the broom is left in the normal rest or storage position as illustrated in FIGS. 1 and 7.

The coupling or pivot mechanism 20 also enables the push broom to be moved into an action position. In this regard refer to FIGS. 10 and 11. Particularly, FIG. 11 shows the handle 14 in a tilted position relative to the pivot mechanism 20 and in readiness for use. In this position the bristles 19 are shown in contact with the floor surface 21 and the push broom is in readiness for use with a sweeping action. The final handle positions are shown as a rest position in FIG. 7 and as a use or action position in FIG. 10. FIG. 7 depicts the angle A between these two positions which may be in a range of 20 degrees to 40 degrees and preferably is on the order of 30 degrees. Also, the head of the broom is defined by a bristle support surface 23, as shown in, for example, FIG. 7 which is orthogonal to the rest surface 17.

Figure 3:
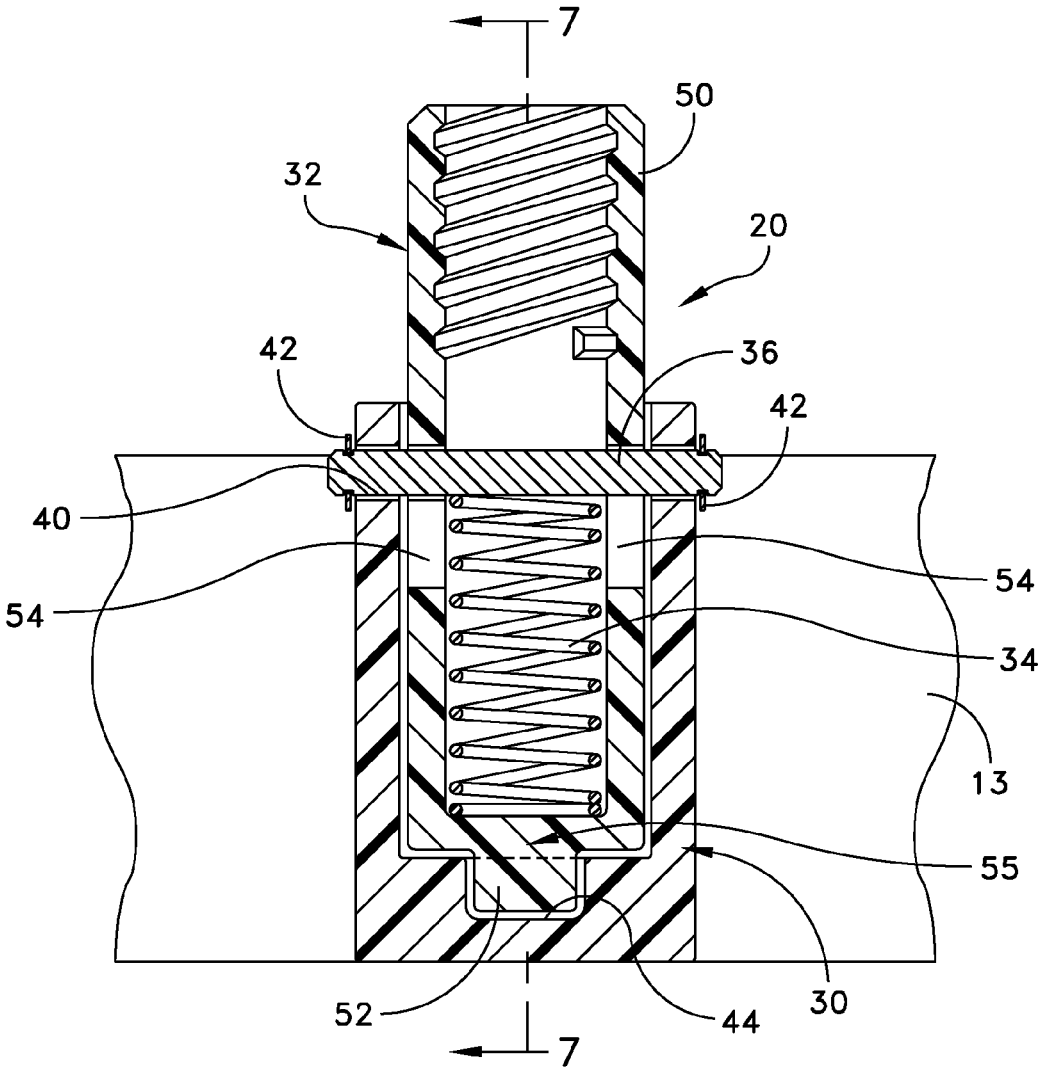
FIG. 3 is a cross-sectional view taken along line 3-3 of FIG. 2 at the pivotal coupling mechanism used for enabling the transition between rest and action positions.

The pivot mechanism 20 as illustrated, for example, in FIGS. 3 and 4 is comprised of a cam body 30, a pivot sleeve 32, a coil spring 34 and pivot pin 36. The body 30 may be permanently attached to the broom plate 13 or, alternatively, the body 30 may be releasably secured to the broom head. For example, the body 30 may be constructed in a manner so that it can be moved between opposite diametric positions and secured in these opposite positions to the plate of the broom head. In the following description the cam body 30 may be considered as fixedly secured to the broom plate 12. This may be secured in a variety of different ways such as by being screwed or bolted to the broom head plate. The body 30 has opposed holes 40 for receiving the pivot pin 36. Securing clips 42 are illustrated for holding the pivot pin 36 in place. Refer to FIGS. 3 and 4. Other means may also be provided for holding the pivot pin 36 in place. The cam body 30 also has internal engagement recesses 40 and 45 and has an open front 46 into which the pivot sleeve 32 fits.

Figure 5:
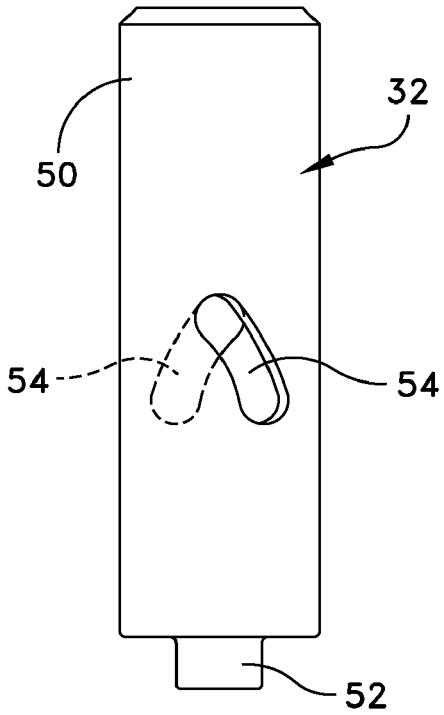
FIGS. 5 and 6 are side elevation views illustrating the slot arrangement in the pivot sleeve that comprises part of the coupling mechanism.
Figure 6:
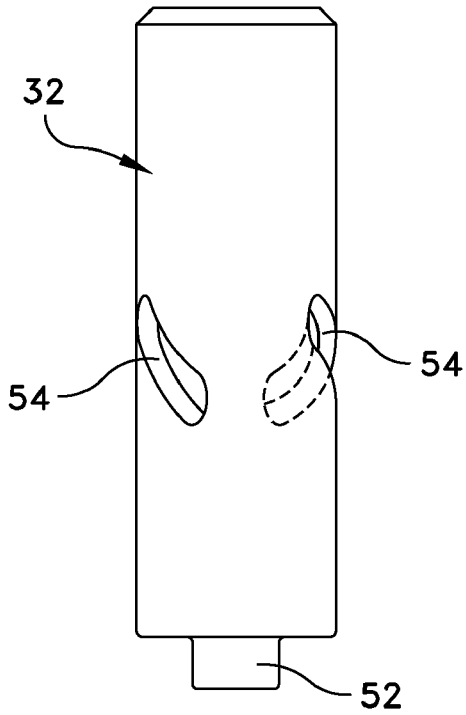

The pivot sleeve 32 has an internally threaded top section 50, a lower engagement post 52 and diametrically disposed slots 54. Refer to the side elevation views of FIGS. 5 and 6 for an illustration of the pivot sleeve 32 and the position of the diametric slots 54 as well as the lower engagement post 52. As illustrated in FIG. 7, the internally threaded top section 50 receives the threaded end 15 of the handle 14. The lower engagement post 52 is meant for engagement with either one of the recesses 44 or 45 depending upon whether the handle is in the rest or use position. As illustrated in FIG. 7, the post 52 engages with the recess 44 in the rest position and as indicated in FIGS. 10 and 11, the post 52 engages with the recess 45 in the use or action position. The slots 54 are preferably slightly arcuate in shape as depicted in FIGS. 5 and 6 and are disposed in the manner as illustrated in FIGS. 5 and 6.

In an alternate embodiment of the invention these slots may simply be longitudinally extending and diametrically disposed linear slots. The arcuate slots illustrated are preferred as that enables longitudinal displacement of the pivot sleeve by a rotational action, as described in further detail hereinafter. The pivot pin 36 is adapted to ride within the slots 54. The pivot pin 36, as illustrated in FIG. 3, also functions to hold the spring 34 in place. One end of the spring 34 contacts the pivot pin 36 and the other end of the spring is seated at a bottom wall 55 of the pivot sleeve 32. The coil spring 34 in its rest position urges the pivot pin 36 to the top end of the respective slots 54.

One of the attributes of the construction of the present invention is the ability to quite easily transition from the rest position such as shown in FIG. 1 to a use position such as shown in the fragmentary view of FIG. 11. With the construction illustrated in FIGS. 1-11, this can be accomplished by simply a flick of the wrist so as to disengage from the position shown in FIG. 7 to move to the position shown in FIG. 10. This action occurs by holding the broom handle and flicking the head downwardly while rotating the handle to enable a disengagement such as illustrated in FIG. 8, a pivoting of the handle such as to the position shown in FIG. 9 and a re-engagement such as to the position shown in FIG. 10.

FIG. 7 is a cross-sectional view taken along line 7-7 of FIG. 3 and illustrates the broom and handle in the rest position. This is the same position shown in FIG. 1. In that position the bristles 19 are in parallel with the floor surface and the handle 14 is held in a substantially upright position. In this position the pressure imparted by the spring 34 holds the engagement post 52 in the recess 44 and thus the handle is maintained in a substantially upright position. In the position illustrated in FIG. 7, the broom is free standing and it is not required to hang the broom from any surface nor is it required to lean the broom against any surface.

Figure 8:
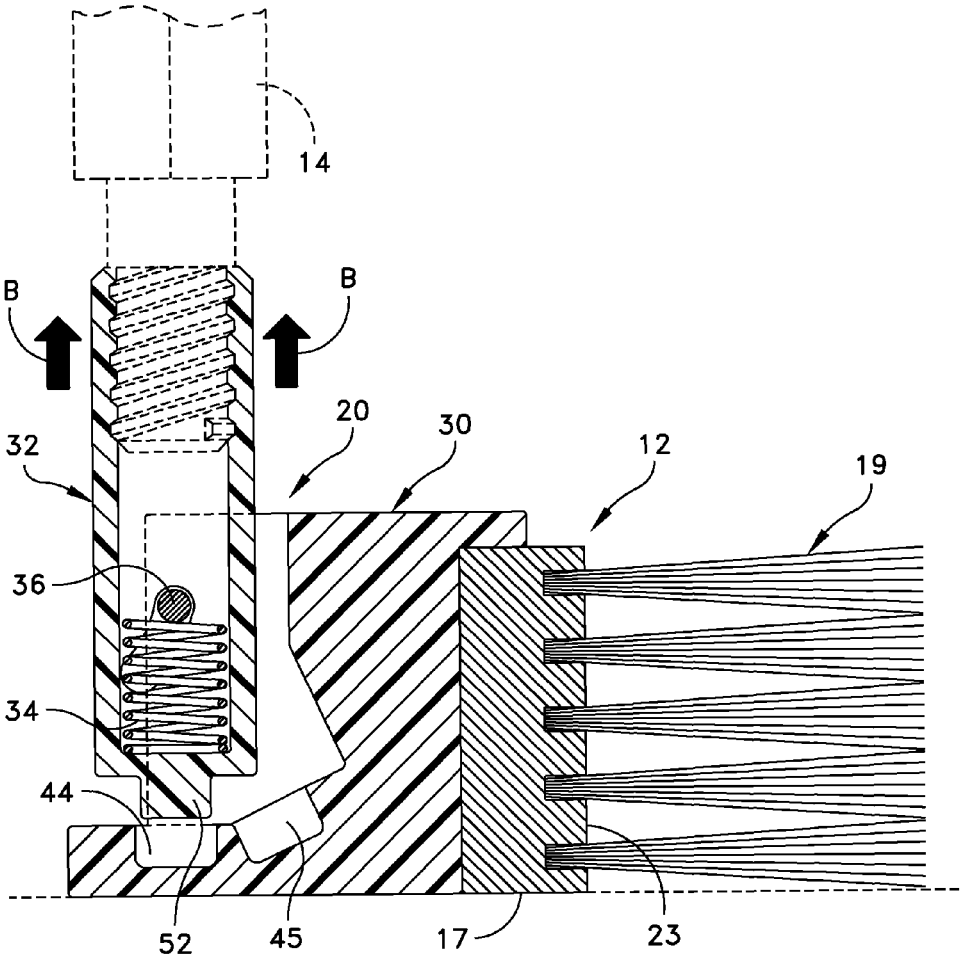
FIG. 8 is a cross-sectional view similar to that shown in FIG. 7 and illustrating the manner in which the handle is initially lifted to disengage from the rest position.
Figure 9:
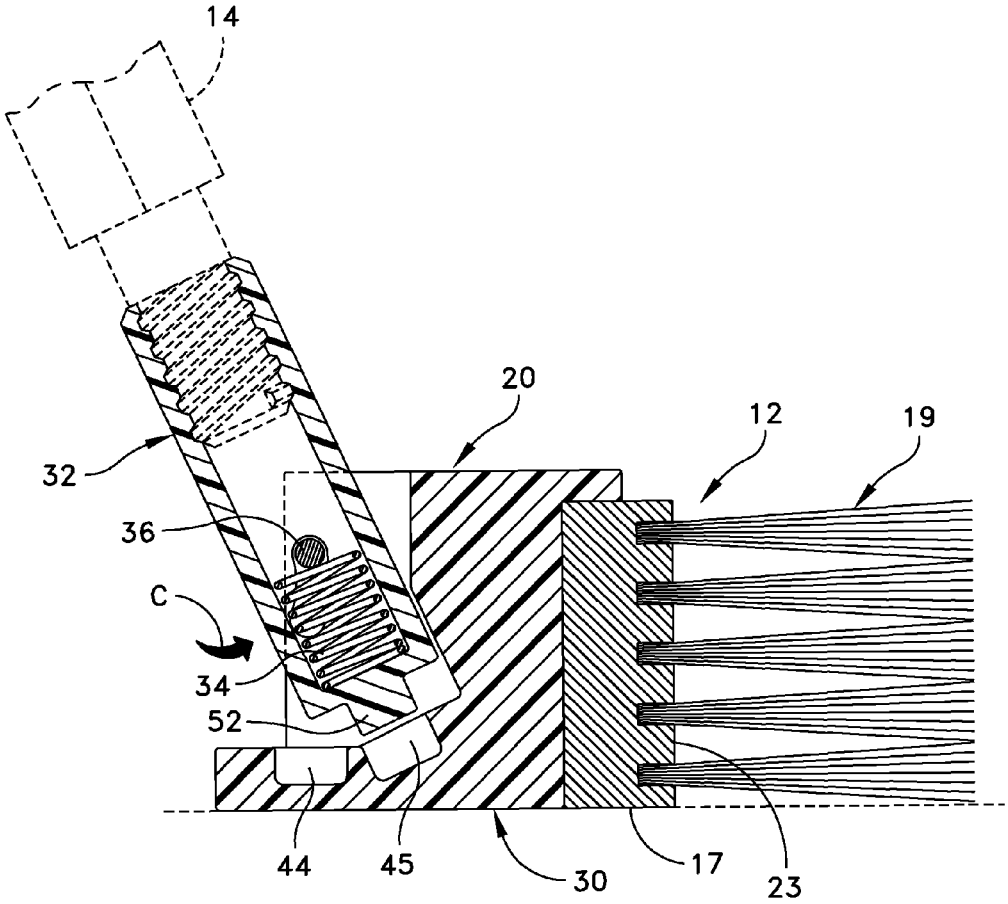
FIG. 9 is a cross-sectional view similar to that shown in FIG. 7 and illustrating the further tilting of the handle in readiness for movement to the action position.

FIGS. 8-10 now illustrate the sequence used in moving the broom handle from the rest position to the use or action position. This involves lifting the sleeve member 32 so that it disengages from the recess 44, pivoting the handle and then reinserting the engagement post 52 of the sleeve member of the pivot sleeve into the recess 45. FIG. 8 illustrates by arrows B a lifting of the handle, along with the pivot sleeve so that the engagement post 52 disengages from the recess 44. FIG. 9 illustrates the pivoting of the handle 14 about the pin 36 with the spring 34 still compressed but with the engagement post 52 now in line with the recess 45. FIG. 9 also illustrates by arrow C a rotational aspect of this transition. In other words, the user may grasp the handle, flick the handle toward the broom head while rotating the handle slightly. Because of the curved nature of the slots 54, this causes a lifting of the pivot sleeve out of engagement with the recess 44. Virtually at the same time, the handle may be pivoted to the position illustrated in FIG. 9 and when the handle is released the engagement post 52 then engages with the recess 45. Refer to the position shown in FIG. 10 and the arrows D illustrating the movement of the pivot sleeve with the engagement post 52 engaging into the recess 45. The rotation that is referred to, and indicated by the arrow C in FIG. 9, may be either clockwise or counterclockwise depending upon the direction of curvature of the slots 54. Also, as indicated previously, the slots 54 may be straight longitudinally extending slots in which case the disengagement occurs primarily by flicking the head of the broom away from the handle while pivoting the handle once the disengagement occurs.

Reference is now made to FIG. 12 for an alternate embodiment of the present invention. This embodiment is substantially the same as the first embodiment except for the fact that the aforementioned body of the pivot mechanism is integrally formed with the broom head. Thus, in FIG. 12 there is shown a broom head 112 that is comprised of a plate member 113 supporting the bristles 119. The handle 114 engages with a pivot sleeve 122. The pivot sleeve 122 forms a part of the pivot mechanism 120. FIG. 12 also shows the pivot pin 136. In FIG. 12 the pivot mechanism 120 is not shown in great detail as it may be substantially identical to the pivot mechanism 12 previously described in connection with FIGS. 1-11. Thus, in addition to the pivot sleeve 122, the pivot mechanism also includes an internal spring (not shown) and the pivot pin 136. The operation of the broom illustrated in FIG. 12 functions substantially the same as previously described in connection with the first embodiment illustrated in FIGS. 1-11.

Reference is now made to another embodiment of the present invention illustrated in FIGS. 13-15. This embodiment includes a broom head 212 that includes the broom plate 213 for supporting bristles 219. FIGS. 13-15 also show the handle 214 that engages with a pivot sleeve 232. The pivot sleeve 232 is supported in the cam body 230.

The embodiment illustrated in FIGS. 13-15 differs from the embodiment illustrated in FIGS. 1-11 in that the slots 254 are disposed in the body 230 rather than in the pivot sleeve 232. Also, the pivot pin 236, rather than being supported by the body, is supported by the pivot sleeve 232. The other primary difference between the embodiment of FIGS. 13-15 and that of FIGS. 1-11 is that the engagement between the pivot sleeve and the body is different. Instead of providing a post at the end of the pivot sleeve, in the embodiment of FIGS. 13-14, a recess 252 is provided at the bottom end of the pivot sleeve 232. This recess 252 is engageable with either of the posts 244 or 245 depending upon the position of the handle 214. In FIG. 14 the pivot sleeve 232 has its recess 252 engaged with the post 244. This represents the rest position of the broom. FIG. 15, on the other hand, illustrates the action position of the broom in which the recess 252 engages with the post 245 extending from the bottom end of the opening in the pivot mechanism 230.

The embodiment of FIGS. 13-15 also illustrates the slots 254 as arcuate in shape. Alternatively, these slots may also be straight slots and may extend longitudinally of the pivot sleeve. The embodiment illustrated in FIGS. 13-15 also includes a spring (not shown) but arranged in the manner as previously described in connection with earlier cross-sectional views such as the view shown in FIG. 7 relating to the first embodiment of the present invention illustrated in FIGS. 1-11.

Having now described a limited number of embodiments of the present invention, it should now be apparent to those skilled in the art that numerous other embodiments and modifications thereof are contemplated as falling within the scope of the present invention, as defined by the appended claims.

What is claimed is:

1. A cleaning apparatus comprising:

a support head that includes a support plate and a cleaning member for support by the support plate;

said support plate having a rest surface and a support surface;

an elongated handle attached to the support plate of the support head and for controlling a sweeping action of the support head;

a coupling member for inter-connecting the elongated handle with the support head;

said coupling member comprising a pivot mechanism having alternate rest and action positions;

said pivot mechanism further including a holding body at the support head, a pivot sleeve received by the holding body, a pivot pin supported between the holding body and pivot sleeve, and at least one elongated slot in one of the pivot sleeve and holding body;

said pivot pin received in said elongated slot so as to ride therealong in a direction of a longitudinal axis of the elongated handle to move longitudinally between alternate positions;

whereby, in the rest position, the support head rests on the rest surface of the support plate so that the handle is substantially upright to maintain the cleaning apparatus substantially free-standing; and whereby, in the action position, the handle is pivoted relative to the support head so as to enable the sweeping action of the support head by a user of the apparatus.

2. The cleaning apparatus of claim 1 wherein the support head is a broom head and the cleaning member include bristles.

3. The cleaning apparatus of claim 1 wherein the support head is a mop head.

4. The cleaning apparatus of claim 1 wherein the rest surface is substantially orthogonal to the support surface.

5. The cleaning apparatus of claim 1 wherein the elongated slot is disposed in the pivot sleeve.

6. The cleaning apparatus of claim 1 wherein the elongated slot is disposed in the holding body.

7. The cleaning apparatus of claim 1 wherein the elongated slot has an arcuate shape.

8. The cleaning apparatus of claim 1 wherein the pivot mechanism further includes a spring held by the pivot pin and disposed in the pivot sleeve.

9. The cleaning apparatus of claim 1 wherein the pivot sleeve has an end engagement piece that selectively engages separately spaced apart receiving elements of the holding body that define the separate rest and action positions of the pivot mechanism.

10. The cleaning apparatus of claim 9 wherein the end engagement piece is a post and the receiving element is a recess into which the post is engaged.

11. The cleaning apparatus of claim 10 wherein the holding body has adjacent recesses for receiving the end of the pivot sleeve that are separated by an acute angle.

12. A push broom comprising:

a broom head that includes a broom plate for supporting bristles or the like;

said broom plate having a rest surface and a bristle support surface;

an elongated handle attached to the broom plate of the broom head and for controlling a sweeping action of the broom head;

a pivotal coupling member for mounting the elongated handle with the broom head;

said pivotal coupling member having separate positions including a rest position in which the broom head rests on the rest surface of the broom plate so that the handle is substantially upright to maintain the broom free-standing and an action position in which the handle is pivoted relative to the broom head so as to enable the sweeping action of the broom head by a user;

said pivotal coupling member including a holding body at the broom head, a pivot sleeve received by the holding body, a pivot pin supported between the holding body and pivot sleeve, and at least one elongated slot in one of the pivot sleeve and holding body;

said pivot pin received in said elongated slot so as to ride therealong in a direction of a longitudinal axis of the elongated handle to move longitudinally between alternate positions.

13. The push broom of claim 12 wherein the rest surface is substantially orthogonal to the support surface.

14. The push broom of claim 12 wherein the elongated slot is disposed in the holding body attached to the broom plate.

15. The push broom of claim 14 wherein the pivotal coupling member further includes a spring held by the pivot pin and disposed in the pivot sleeve.

16. The push broom of claim 12 wherein the pivot sleeve rotates about its longitudinal axis in transitioning between the rest and action positions.

17. The push broom of claim 12 wherein the elongated slot is disposed in the pivot sleeve.

18. The push broom of claim 12 wherein the pivot sleeve has an end engagement piece that selectively engages separately spaced apart receiving elements of the holding body that define the separate rest and action positions.

19. The push broom of claim 18 wherein the end engagement piece is a post and the receiving element is a recess into which the post is engaged.

20. The push broom of claim 19 wherein the holding body has adjacent recesses for receiving the end of the pivot sleeve that are separated by an acute angle.

21. A cleaning apparatus comprising:

a support head that includes a support plate and a cleaning member for support by the support plate;

an elongated handle attached to the support plate of the support head and for controlling an action of the support head;

a coupling member for inter-connecting the elongated handle with the support head;

said coupling member comprising a pivot mechanism having alternate rest and action positions;

said pivot mechanism further including a holding body at the support head, a pivot sleeve received by the holding body, a pivot pin supported between the holding body and pivot sleeve, and at least one elongated slot in one of the pivot sleeve and holding body;

said pivot pin received in said elongated slot so as to ride therealong in a direction of a longitudinal axis of the elongated handle to move longitudinally between alternate positions;

said pivot sleeve having an end engagement piece that selectively engages separately spaced apart receiving elements of the holding body that define the separate rest and action positions of the pivot mechanism;

said receiving elements being separated by an acute angle so that the handle can be locked in alternate respective positions.

22. The cleaning apparatus of claim 21 wherein the elongated slot is disposed in the pivot sleeve.

23. The cleaning apparatus of claim 21 wherein the elongated slot is disposed in the holding body.

24. The cleaning apparatus of claim 21 including a spring disposed within said pivot sleeve to contact said pivot pin for urging said pivot pin toward one end of the elongated slot.

25. The cleaning apparatus of claim 24 wherein the elongated slot has an arcuate shape.

* * * * *